US011497296B2

(12) United States Patent
McMicken

(10) Patent No.: US 11,497,296 B2
(45) Date of Patent: Nov. 15, 2022

(54) CAMPING OR LOUNGING SYSTEM CONFIGURED TO BE DEPLOYABLE IN MULTIPLE MODES

(71) Applicant: KIT, LLC, Salt Lake City, UT (US)

(72) Inventor: Chase McMicken, Salt Lake City, UT (US)

(73) Assignee: KIT, LLC, Salt Lake City, UT (US)

( * ) Notice: Subject to any disclaimer, the term of this patent is extended or adjusted under 35 U.S.C. 154(b) by 0 days.

(21) Appl. No.: 17/288,242

(22) PCT Filed: Oct. 24, 2019

(86) PCT No.: PCT/US2019/057937

§ 371 (c)(1),
(2) Date: Apr. 23, 2021

(87) PCT Pub. No.: WO2020/086894

PCT Pub. Date: Apr. 30, 2020

(65) Prior Publication Data

US 2021/0386182 A1 Dec. 16, 2021

Related U.S. Application Data

(60) Provisional application No. 62/751,495, filed on Oct. 26, 2018.

(51) Int. Cl.
*A45F 3/22* (2006.01)
*A45F 4/04* (2006.01)
(Continued)

(52) U.S. Cl.
CPC ..... *A45F 4/00* (2013.01); *A45F 3/22* (2013.01); *A45F 4/04* (2013.01); *A45F 4/08* (2013.01);
(Continued)

(58) Field of Classification Search
USPC ..... 135/95–97
See application file for complete search history.

(56) References Cited

U.S. PATENT DOCUMENTS 402,469 A * 4/1889 Messmore ..... A47C 3/0255 297/278
788,815 A * 5/1905 Berrio ..... A45F 3/22 5/121
(Continued)

OTHER PUBLICATIONS

International Search Report and Written Opinion dated Jan. 10, 2020 in PCT International Patent Application No. PCT/US2019/057937.

*Primary Examiner* — Robert Canfield
(74) *Attorney, Agent, or Firm* — Snell & Wilmer L.L.P.

(57) ABSTRACT

A system, such as a camping or lounging system, includes a first spreader bar and a second spreader bar. The system also includes a hammock-tent defining a first end sleeve and a second end sleeve, wherein the first spreader bar is configured to be removably inserted into the first end sleeve and the second spreader bar is configured to be removably inserted into the second end sleeve. The system also includes at least one bracket, wherein at least one of the first spreader bar and the second spreader bar is configured to be detachably coupled with the at least one bracket to form a chair framework. The system may be deployable in a hammock-tent mode or a chair mode.

10 Claims, 5 Drawing Sheets

(51) Int. Cl.

| | |
|---|---|
| ***A45F 4/08*** | (2006.01) |
| ***A47C 4/28*** | (2006.01) |
| ***A45F 4/00*** | (2006.01) |
| ***A47C 13/00*** | (2006.01) |
| ***E04H 15/04*** | (2006.01) |
| ***A47C 4/52*** | (2006.01) |
| *E04H 15/42* | (2006.01) |
| *A45F 4/02* | (2006.01) |
| *A45B 5/00* | (2006.01) |

(52) U.S. Cl.

CPC ..... *A47C 4/28* (2013.01); *A47C 4/52* (2013.01); *A47C 13/00* (2013.01); *E04H 15/04* (2013.01); *A45B 5/00* (2013.01); *A45F 2004/026* (2013.01); *E04H 15/42* (2013.01)

(56) References Cited

U.S. PATENT DOCUMENTS 869,753 A * 10/1907 Till et al. ..... A47C 13/00 297/7
3,912,138 A 10/1975 Pava
4,071,917 A * 2/1978 Mojica ..... E04H 15/04 135/96
4,471,794 A * 9/1984 Kirkham, Jr. ..... A45F 3/22 5/120
4,526,307 A * 7/1985 Parker ..... E04H 15/04 224/154
5,240,021 A * 8/1993 Snodgrass ..... E04H 15/425 5/127
5,277,349 A * 1/1994 Rowe ..... A45F 4/04 224/636
5,709,428 A * 1/1998 Hugghins ..... A47C 4/48 297/16.2
7,698,756 B1 * 4/2010 Chen ..... A47C 29/003 135/96
8,991,667 B2 * 3/2015 Perez ..... A45F 4/04 5/418
2012/0104805 A1 5/2012 Lah
2013/0313865 A1 * 11/2013 Homans ..... A47C 4/30 297/16.1
2015/0052682 A1 * 2/2015 Biswell ..... A61G 1/013 297/452.2
2016/0113402 A1 4/2016 Lee
2018/0235368 A1 * 8/2018 Graybill ..... A47C 4/02

* cited by examiner

CAMPING OR LOUNGING SYSTEM CONFIGURED TO BE DEPLOYABLE IN MULTIPLE MODES

CROSS REFERENCE TO RELATED APPLICATIONS

This application is a U.S. national stage entry under 35 U.S.C. § 371 of International Application No. PCT/US2019/057937 filed Oct. 24, 2019 entitled "CAMPING OR LOUNGING SYSTEM CONFIGURED TO BE DEPLOYABLE IN MULTIPLE MODES", which claims priority to, and the benefit of, U.S. Provisional Patent Application Ser. No. 62/751,495, filed on Oct. 26, 2018, the entire contents of which are incorporated herein by reference in their entirety.

FIELD

The present disclosure relates to outdoor camping and lounging equipment, and more particularly to a kit and/or system that is configurable and deployable in multiple modes of use.

BACKGROUND

Conventional camping equipment is often bulky and/or heavy, and is not able to be adapted and/or modified for different use-scenarios. That is, conventional camping equipment often cannot be reconfigured and redeployed in multiple combinations to provide for different use scenarios. For example, if a user wants to hammock-camp one night, tent-camp the next, and also lounge in a chair during the day, the user would need to bring along multiple pieces of equipment, each with its own components and accessories, in order to enjoy the desired user experience, thus adding to the weight and/or bulk of his/her pack.

SUMMARY

In various embodiments, the present disclosure provides a system, such as a camping or lounging system, comprising a first spreader bar and a second spreader bar. The system further comprises a hammock-tent defining a first end sleeve and a second end sleeve, wherein the first spreader bar is configured to be removably inserted into the first end sleeve and the second spreader bar is configured to be removably inserted into the second end sleeve. Still further, the system includes at least one bracket, wherein at least one of the first spreader bar and the second spreader bar is configured to be detachably coupled with the at least one bracket to form a chair framework. The system may be deployable in a hammock-tent mode, with the first spreader bar and the second spreader bar inserted respectively into the first end sleeve and the second end sleeve, and a chair mode, with at least one of the first spreader bar and the second spreader bar coupled to the at least one bracket.

In various embodiments, each of the first spreader bar and the second spreader bar comprises multiple sections. Accordingly, in the hammock-tent mode the multiple sections may be longitudinally coupled together end-to-end and in the chair mode the multiple sections may be longitudinally detached from one another such that individual sections of the multiple sections are coupled to the at least one bracket. In various embodiments, the at least one bracket comprises two brackets.

In various embodiments, the multiple sections of the first spreader bar comprise a first section and a second section, and the multiple sections of the second spreader bar comprise a third section, a fourth section, and a fifth section. The first section and the second section may respectively form lateral sides of a back-supporting portion of the chair framework, the third section and the fourth section may respectively form lateral sides of a buttocks-supporting portion of the chair framework, and the fifth section may form a cross-member extending between the two brackets and extending generally orthogonal to the first section, the second section, the third section, and the fourth section.

In various embodiments, the system further includes a chair fabric configured to be coupled to the chair framework in the chair mode. In various embodiments, the chair fabric is a stuff sack within which at least the hammock-tent, the first spreader bar, and the second spreader bar are configured to be stored (i.e., packed for hiking).

In various embodiments, in response to the first spreader bar and the second spreader bar being removed from the first end sleeve and the second end sleeve, the hammock-tent is configured to be deployed as either a cocoon hammock or a ground tent. The hammock-tent may comprise a first side having tent features and a second side opposite the first side, wherein the cocoon hammock is deployed with the second side up. The system may further include a center strap configured to extend between and be detachably coupled to the first spreader bar and the second spreader bar, wherein the center strap defines two regions in the hammock-tent for two users.

Also disclosed herein, according to various embodiments, is a system comprising a first spreader bar and a second spreader bar. The system also includes a suspendable platform defining a first end sleeve and a second end sleeve, wherein the first spreader bar is configured to be removably inserted into the first end sleeve and the second spreader bar is configured to be removably inserted into the second end sleeve, according to various embodiments. Still further, the system includes at least one bracket, wherein at least one of the first spreader bar and the second spreader bar is configured to be detachably coupled with the at least one bracket to form a chair framework, according to various embodiments.

The system may be deployable in a flat mode, with the first spreader bar and the second spreader bar inserted respectively into the first end sleeve and the second end sleeve, and a chair mode, with at least one of the first spreader bar and the second spreader bar coupled to the at least one bracket. In various embodiments, the suspendable platform comprises features for coupling at least one of a tent structure or other covering thereto.

The forgoing features and elements may be combined in various combinations without exclusivity, unless otherwise expressly indicated herein. These features and elements, as well as the operation of the disclosed embodiments, will become more apparent in light of the following description and accompanying drawings.

Figure 1:
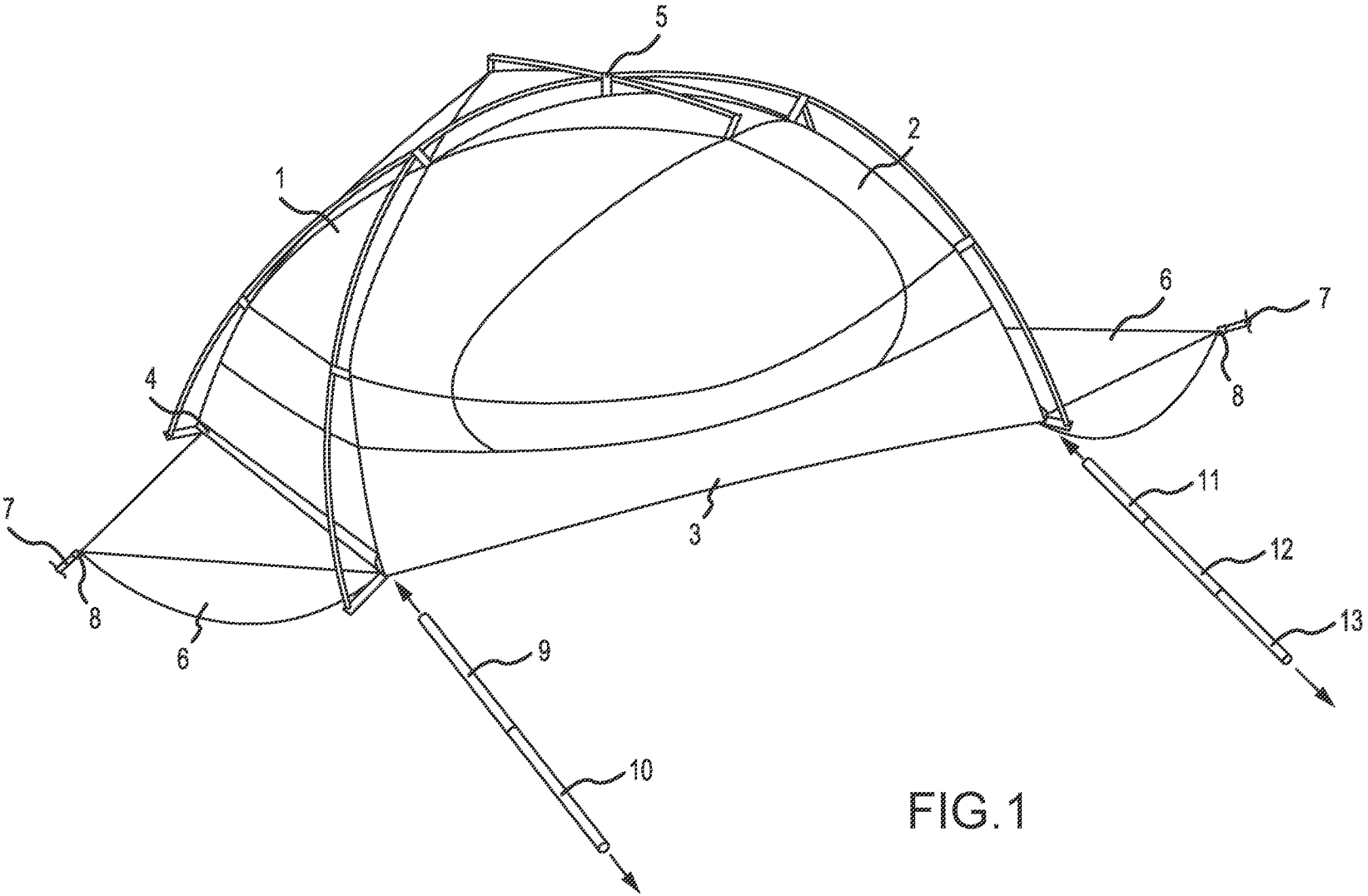
FIG. 1 is a perspective view of a system, such as a camping or lounging system, deployed in a hammock-tent mode (having removable spreader bars to tension the bottom fabric of the hammock-tent), in accordance with various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation.

Disclosed herein, according to various embodiments and with reference to the accompanying figures, is a camping system comprising components that can be configured and deployed in multiple modes of use. The disclosed system reduces the overall weight of outdoor equipment needed for camping and hiking and reduces the amount of space your equipment takes up by providing a gear kit that is able to conform to multiple different equipment combinations, according to various embodiments. With these different combinations available to the user, the system is adaptable to a variety of different environments and reduces the overall need for multiple different pieces of camping equipment.

Generally, the system includes components that can be configured to provide one or more of the following: a hammock, a tent, a suspended-tent, and a camping chair, according to various embodiments. For example, the disclosed system is generally configurable in multiple modes, such as a hammock-tent mode, a hammock and chair mode, and a tent and chair mode, according to various embodiments. As described in greater detail below, the system may be deployed as a hammock-tent suspended between two load bearing structures (e.g., trees) with an adjustable strapping system and a stabilization system. The stabilization system may prevent the hammock-tent from rolling or flipping when in use. The hammock-tent can also be converted into a ground tent, a traditional cocoon hammock and a lightweight chair, as described in greater detail below. In the hammock-tent position/mode, the hammock-tent creates a substantially flat lay (e.g., flatter than a traditional cocoon hammock) by inserting two spreader bars into sleeves towards the end of the hammock. These spreaders bars are used to tension the bottom fabric in order to create a flat-lay position.

The spreaders bars used to create the hammock-tent configuration can also be removed and repurposed by breaking the poles down and reassembling them into a chair, as described in greater detail below. When converting the hammock-tent into the hammock and chair configuration, the tent poles used to hold up the rain fly are taken down and the spreader bars are taken out of the hammock sleeves. The spreader bars can then be repurposed to create a chair. When the tent poles and the spreader bars have been removed from the hammock-tent, you can then roll up the upper portion of the tent and secure it down, flip the hammock-tent 180 degrees so the bottom of the tent is facing up. This will create a cocoon shaped hammock. This combination will give you the hammock and chair position.

In order to set up the third configuration, you simply set up the tent on the ground without the spreader bars and stake the tent into the ground. In this position, the tent does not need the spreader bars to keep it tensioned which allows them to be used as a chair, giving you a ground tent and a chair at the same time. Additional details pertaining to the system and how it is configured and deployed in these modes/positions are included below, with reference to the accompanying figures.

In accordance with various embodiments, and with reference to FIG. 1, the present disclosure comprises of a hammock-tent 1 being suspended in the air by strapping 7 which may be tensioned by hardware 8. Strapping 7 may be made of a material with high strength rating and minimal stretch when tensioned. An extension from the cocoon hammock converted to the flat-lay hammock-tent is demonstrated by 6 to create an area that resembles a large pocket or area to store items off the ground, according to various embodiments. When the spreader bars are removed from the hammock, this area may become part of the cocoon hammock. The bottom of the hammock-tent 3 may be manufactured from a waterproof textile. This textile fabric used for the bottom of the hammock-tent 3 can also be made out of a reinforced fabric able to bare more weight than a traditional tent. Such fabrics may consist of but are not limited to; nylon, polyester, cotton and synthetic blends. The covering 2 is held up by tent poles 5 in order to hold a structural shape, according to various embodiments. The covering 2 may be made out of a lightweight material that provides protection from outside elements. The hammock-tent may be able to create a flat-lay by having the spreader bars, shown in FIG. 1 retracted from the sleeves, inserted into pole sleeves 4. The hammock-tent may also have a tensioning line extending along lateral sides of the base of the hammock-tent.

Figure 2:
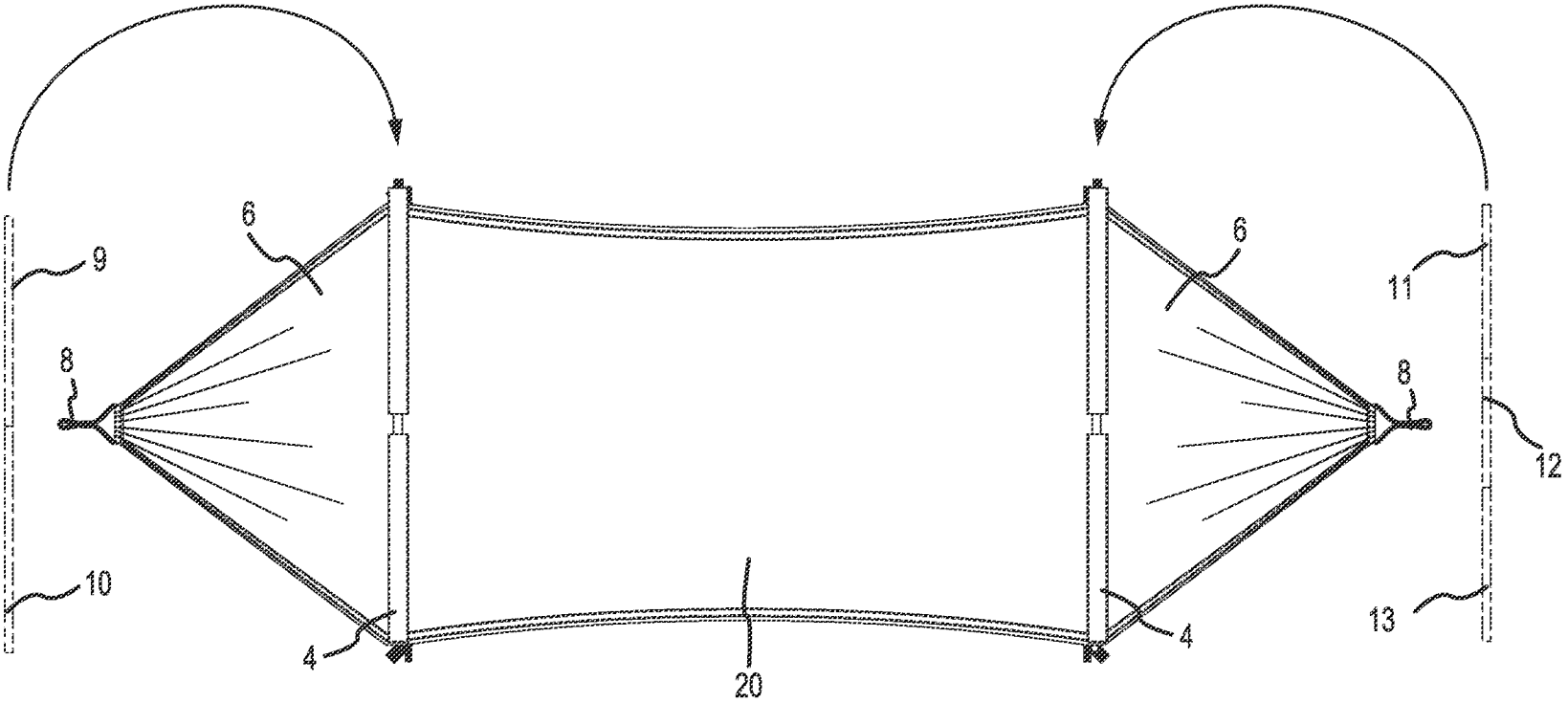
FIG. 2 is a bottom view of a system, such as a camping or lounging system, with a hammock-tent be utilized as a suspendable platform (having removable spreader bars to tension the fabric of the suspendable platform), in accordance with various embodiments.

In various embodiments, and with reference to FIGS. 1, 2, and 3, the present disclosure comprises the spreader bars being used to slide into pole sleeve 4 in order to tension the bottom of the hammock-tent 3. The spreader bars may be made out of lightweight weight baring material. The first spreader bar may be formed by connecting pieces 9 and 10 together to make one of two spreader bars, and the second spreader bar may be formed by connecting pieces 11, 12, and 13 together to make the second of two spreader bars. In various embodiments, the spreader bars may be broken into a different number of sections.

Figure 4A:
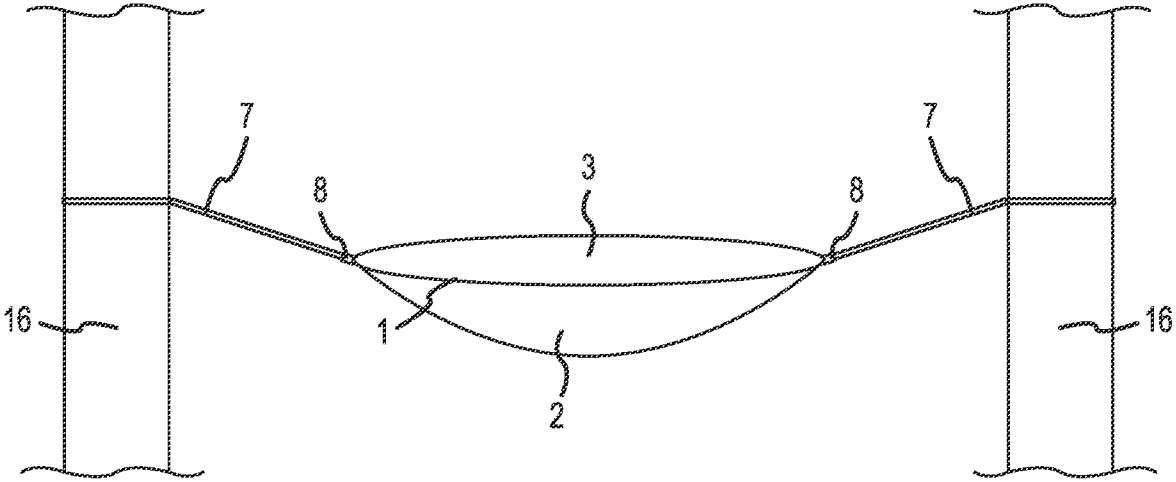
FIG. 4A is a side view of a system, deployed as a cocoon hammock, in accordance with various embodiments.
Figure 4B:
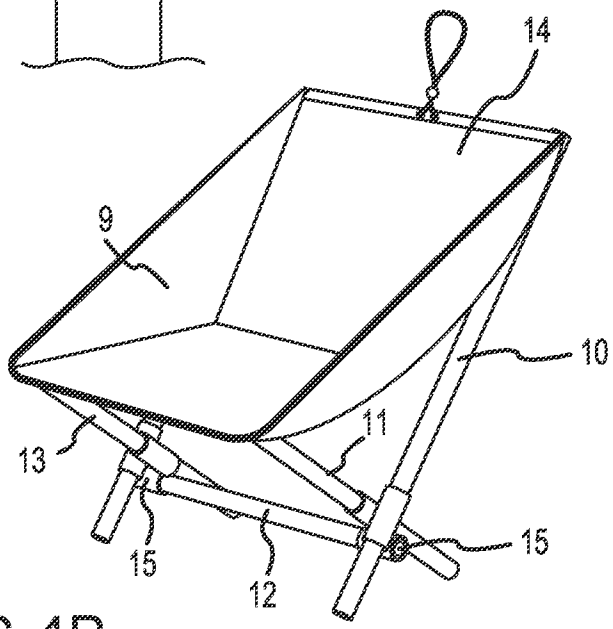
FIG. 4B is a perspective view of a chair comprising a chair framework formed from spreader bars of the system, in accordance with various embodiments.

In accordance with various embodiments, and with reference to FIG. 4B, the two spreader bars may be removed from the sleeves of the hammock-tent and may be utilized/deployed to form a chair framework. The chair may include chair fabric 14 that is coupled and structurally supported by spreader bar sections 9, 10, 11, 12, and 13. The sections of the spreader bars may be coupled together using one or more brackets 15. The brackets may hold the sections of the spreader bar(s) together in a desired orientation to form a back-supporting portion and a buttocks-supporting portion.

Referring now to FIG. 4A, the present disclosure comprises of an illustration of the first of three equipment combinations available by the subject invention. In this illustration, the hammock-tent 1 has been converted into a hammock with the bottom of the hammock-tent 3 now facing upwards and the covering 2 being rolled up and secured underneath the hammock. The hammock is able to take its shape once spreader bars 9, 10, 11, 12, and 13 are removed from pole sleeves 4. The hammock-tent and the hammock configurations are supported by strapping 7 with hardware 8 being tensioned, connecting back to load baring structures 16. The combination of FIGS. 4A and 4B shows how you can have a hammock and a chair at the same time using the components of the system. In various embodiments, the hammock-tent can be deployed/utilized as a ground tent. In such a configuration, stakes 17 may be utilized to secure the tent to the ground (e.g., at all four corners) and tent poles 5 may be used to hold up the covering 2 and a rainfly (not pictured). Similar to the deployment shown in FIGS. 4A and 4B, the ground tent implementation may include the spreader bars being used to form the chair.

Returning again to reference FIGS. 1 and 3A, the system of the present disclosure may be deployed in hammock-tent mode, with the hammock-tent 1 suspended by strapping system 7 in between load baring structures 16. The system may include a suspension assembly 18 to prevent the hammock-tent 1 from rolling or flipping when subject invention is in use. Extra space 6 can be used as storage when in the hammock-tent 1 position and converts into a larger piece of the cocoon hammock when converted.

Figure 3A:
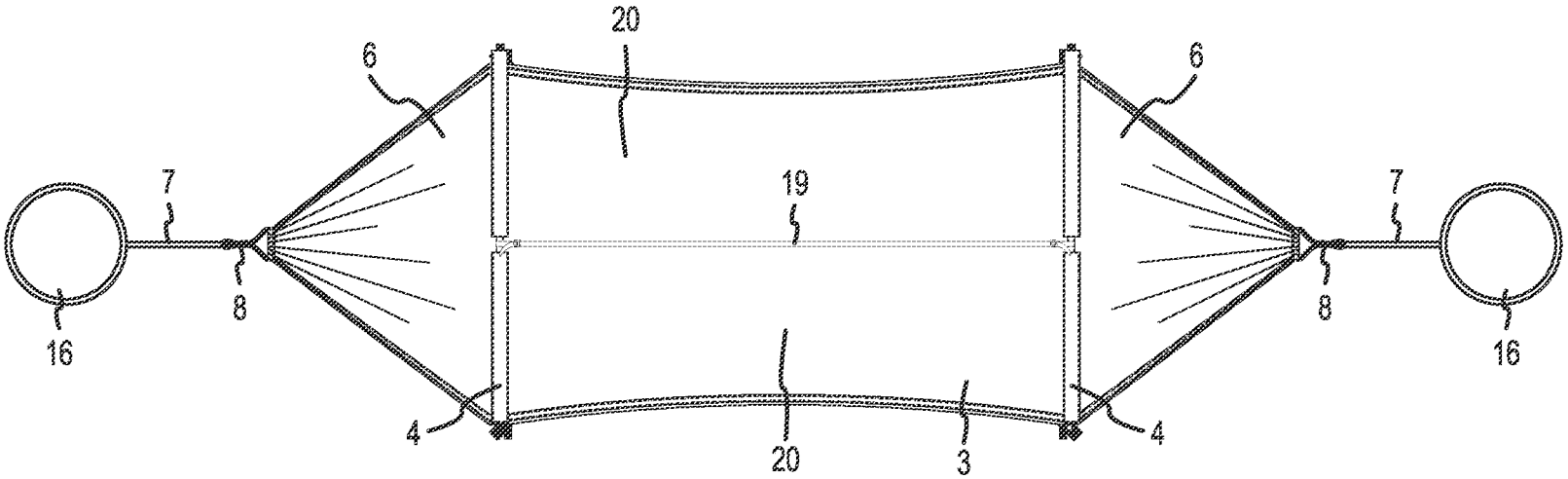
FIG. 3A is a bottom view of a system, deployed in a hammock-tent mode, comprising a center strap extending between the two spreader bars, in accordance with various embodiments.
Figure 3B:
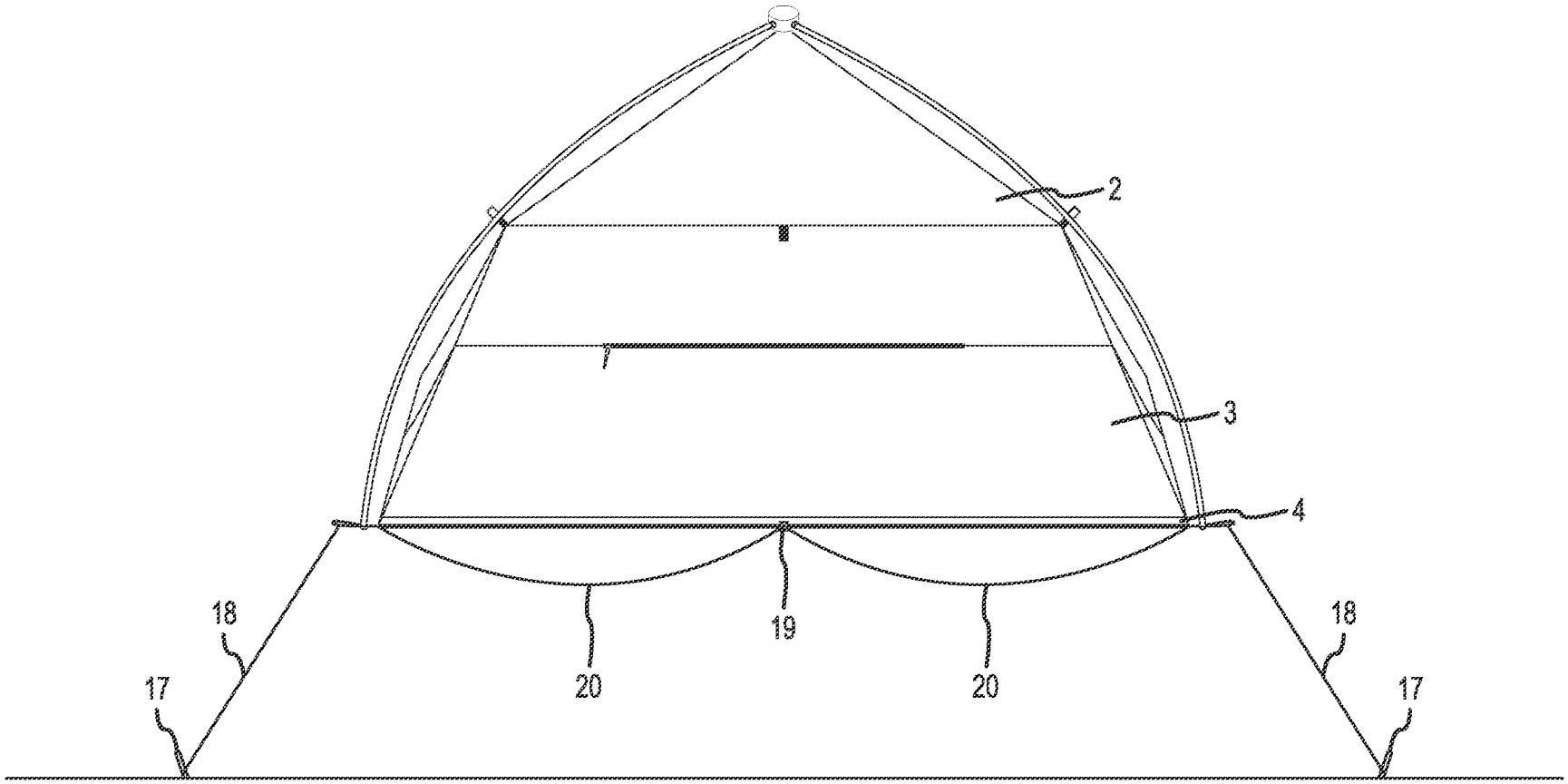
FIG. 3B is an end/front view of a system, deployed in a hammock-tent mode, showing the center strap forming two regions for two users, in accordance with various embodiments.

Referring now to FIG. 3A, the bottom view of the hammock-tent shows an underneath side of the hammock-tent 1. The system may include a center strap 19 extending between and connected to the spreader bars to create two pods or two user regions. The center strap 19 is intended to facilitate the use of a two-person hammock-tent 1. By securing the center strapping system 19, two pods 20 will be formed, preventing the individuals using the hammock-tent from rolling into each other while in use. In various embodiments, and with reference to FIG. 3B, the end view of the hammock-tent 1 shows how the center strap 19, creates two individual pods 20, preventing the users from rolling into each other. Stabilization 18 also shows that hammock-tent 1 should be stabilized while in use. One can stabilize 18 by staking 17 into the ground or connecting to another load barring structure 16. In various embodiments, the pieces and components of the system can be deployed in different combinations to enable the various use modes.

Numerous characteristics and advantages have been set forth in the preceding description, including various alternatives together with details of the structure and function of the devices and/or methods. The disclosure is intended as illustrative only and as such is not intended to be exhaustive. It will be evident to those skilled in the art that various modifications can be made, especially in matters of structure, materials, elements, components, shape, size and arrangement of parts including combinations within the principles of the invention, to the full extent indicated by the broad, general meaning of the terms in which the appended claims are expressed. To the extent that these various modifications do not depart from the spirit and scope of the appended claims, they are intended to be encompassed therein.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A system comprising:

a first spreader bar and a second spreader bar;

a hammock-tent defining a first end sleeve and a second end sleeve, wherein the first spreader bar is configured to be removably inserted into the first end sleeve and the second spreader bar is configured to be removably inserted into the second end sleeve; and at least one bracket, wherein at least one of the first spreader bar and the second spreader bar is configured to be detachably coupled with the at least one bracket to form a chair framework;

wherein the system is deployable in a hammock-tent mode, with the first spreader bar and the second spreader bar inserted respectively into the first end sleeve and the second end sleeve, and a chair mode, with at least one of the first spreader bar and the second spreader bar coupled to the at least one bracket; and each of the first spreader bar and the second spreader bar comprises multiple sections;

in the hammock-tent mode the multiple sections are longitudinally coupled together end-to-end; and in the chair mode the multiple sections are longitudinally detached from one another such that individual sections of the multiple sections are coupled to the at least one bracket.

2. The system of claim 1, wherein the at least one bracket comprises two brackets.

3. The system of claim 2, wherein:

the multiple sections of the first spreader bar comprise a first section and a second section;

the multiple sections of the second spreader bar comprise a third section, a fourth section, and a fifth section;

the first section and the second section respectively form lateral sides of a back-supporting portion of the chair framework;

the third section and the fourth section respectively form lateral sides of a buttocks-supporting portion of the chair framework; and the fifth section forms a cross-member extending between the two brackets and extending generally orthogonal to the first section, the second section, the third section, and the fourth section.

4. The system of claim 1, further comprising a chair fabric configured to be coupled to the chair framework in the chair mode.

5. The system of claim 4, wherein the chair fabric is a stuff sack within which the hammock-tent, the first spreader bar, and the second spreader bar are configured to be stored.

6. The system of claim 1, wherein in response to the first spreader bar and the second spreader bar being removed from the first end sleeve and the second end sleeve, the hammock-tent is configured to be deployed as either a cocoon hammock or a ground tent.

7. The system of claim 6, wherein the hammock-tent comprises a first side having tent features and a second side opposite the first side, wherein the cocoon hammock is deployed with the second side up.

8. The system of claim 1, further comprising a center strap configured to extend between and be detachably coupled to the first spreader bar and the second spreader bar, wherein the center strap defines two regions in the hammock-tent for two users.

9. A system comprising:

a first spreader bar and a second spreader bar;

a hammock-tent defining a first end sleeve and a second end sleeve, wherein the first spreader bar is configured to be removably inserted into the first end sleeve and the second spreader bar is configured to be removably inserted into the second end sleeve;

at least one bracket, wherein at least one of the first spreader bar and the second spreader bar is configured to be detachably coupled with the at least one bracket to form a chair framework; and a chair fabric configured to be coupled to the chair framework in a chair mode;

wherein the system is deployable in a hammock-tent mode, with the first spreader bar and the second spreader bar inserted respectively into the first end sleeve and the second end sleeve, and the chair mode, with at least one of the first spreader bar and the second spreader bar coupled to the at least one bracket, and the chair fabric is a stuff sack within which the hammock-tent, the first spreader bar, and the second spreader bar are configured to be stored.

10. A system comprising:

a first spreader bar and a second spreader bar;

a hammock-tent defining a first end sleeve and a second end sleeve, wherein the first spreader bar is configured to be removably inserted into the first end sleeve and the second spreader bar is configured to be removably inserted into the second end sleeve; and at least one bracket, wherein at least one of the first spreader bar and the second spreader bar is configured to be detachably coupled with the at least one bracket to form a chair framework;

wherein the system is deployable in a hammock-tent mode, with the first spreader bar and the second spreader bar inserted respectively into the first end sleeve and the second end sleeve, and a chair mode, with at least one of the first spreader bar and the second spreader bar coupled to the at least one bracket;

in response to the first spreader bar and the second spreader bar being removed from the first end sleeve and the second end sleeve, the hammock-tent is configured to be deployed as either a cocoon hammock or a ground tent; and the hammock-tent comprises a first side having tent features and a second side opposite the first side, wherein the cocoon hammock is deployed with the second side up.

* * * * *